US005115383A

United States Patent [19]

Lee

[11] Patent Number: 5,115,383

[45] Date of Patent: May 19, 1992

[54] GAME LIGHT APPARATUS

[76] Inventor: Norman K. Lee, 70 Russell St., San Francisco, Calif. 94109

[21] Appl. No.: 610,158

[22] Filed: Nov. 5, 1990

[51] Int. Cl.[5] ..... F21V 33/00

[52] U.S. Cl. ..... 362/109; 362/19; 362/370; 362/372; 273/85 G; 273/148 R

[58] Field of Search ..... 273/85 G, 148 B, 148 R, 273/19, 97, 98, 99, 109, 370, 372

[56] References Cited

U.S. PATENT DOCUMENTS

| | | | |
|---|---|---|---|
| 2,979,990 | 4/1961 | Alexandria | 273/148 B |
| 4,312,507 | 1/1982 | Smith et al. | 273/148 B |
| 4,398,086 | 8/1983 | Smith, III | 273/85 G |
| 4,538,217 | 8/1985 | Ewing et al. | 362/372 |
| 4,751,615 | 6/1988 | Abrams | 362/98 |
| 4,890,832 | 1/1990 | Komaki | 273/85 G |
| 4,893,222 | 1/1990 | Mintzer | 362/23 |

FOREIGN PATENT DOCUMENTS

| | | | |
|---|---|---|---|
| 2450116 | 10/1980 | France | 273/148 R |

*Primary Examiner*—Ira S. Lazarus
*Assistant Examiner*—Y. Quach
*Attorney, Agent, or Firm*—Leon Gilden

[57] ABSTRACT

An apparatus includes a slide-on illumination housing of a generally "U" shaped configuration, including cylindrical guides receivable within elongate grooves that are provided within an associated electronic game member whose housing includes side walls containing the grooves, wherein the illumination member overlies a viewing screen of the game member. The illumination member includes an illumination screen, wherein the illumination screen may be pivotally mounted to the illumination housing and may further include a polarized filter to limit intensity of light directed onto the viewing screen.

4 Claims, 4 Drawing Sheets

FIG 1
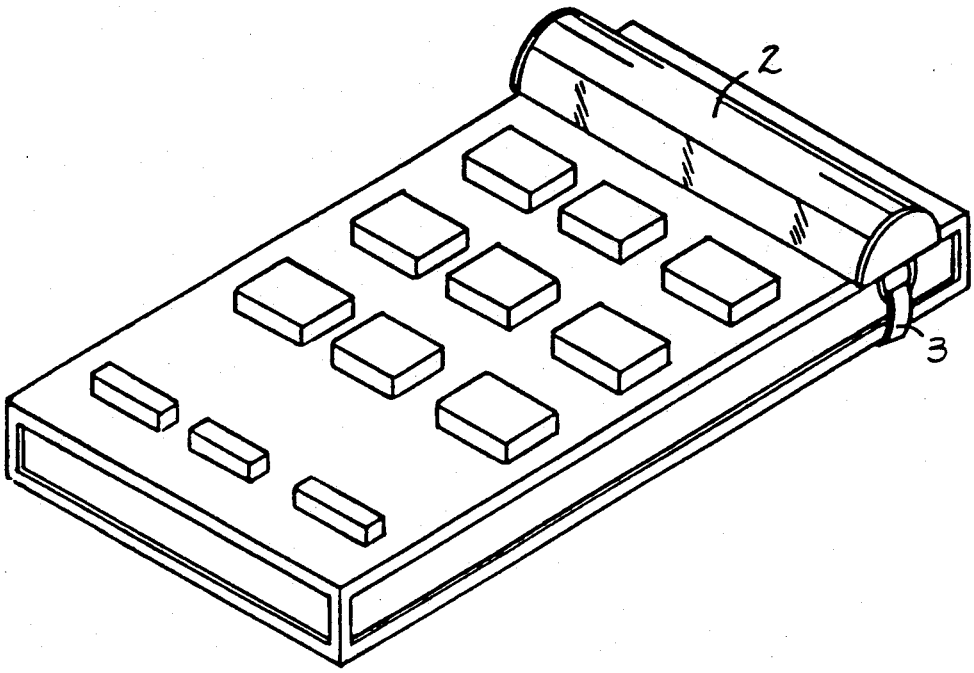
PRIOR ART
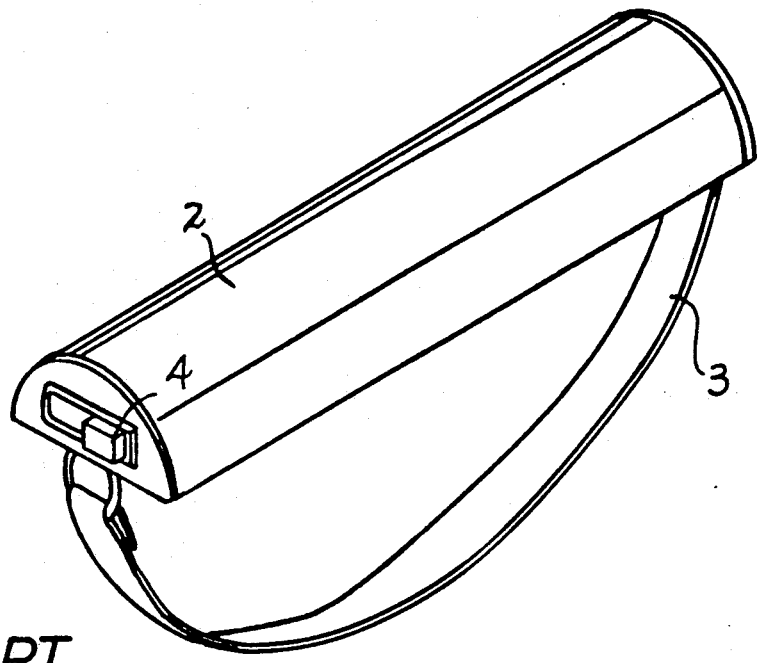
FIG. 2
PRIOR ART

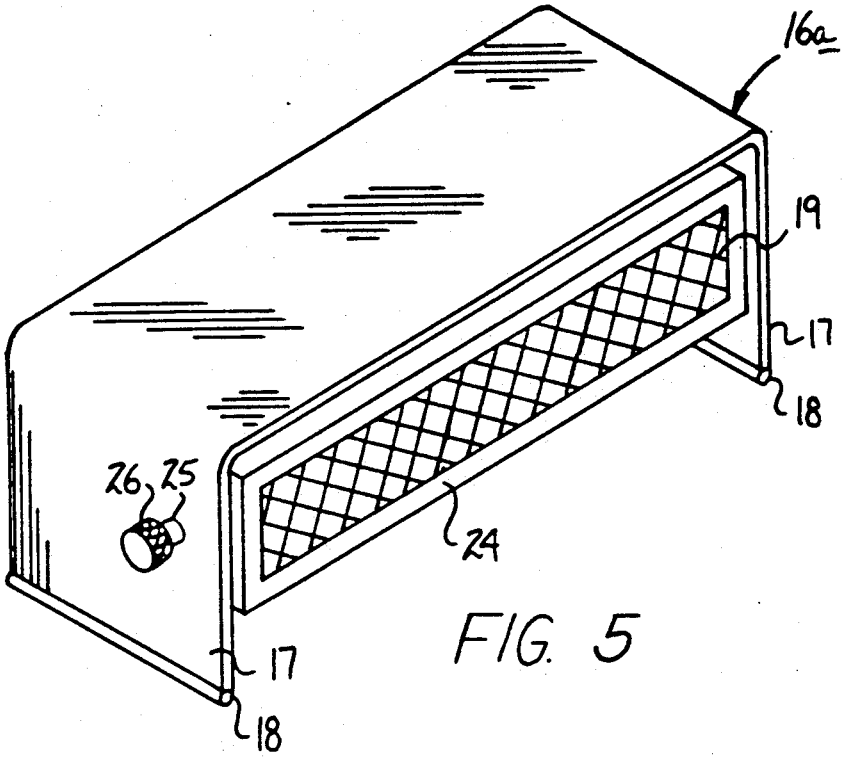
FIG. 5
FIG. 6
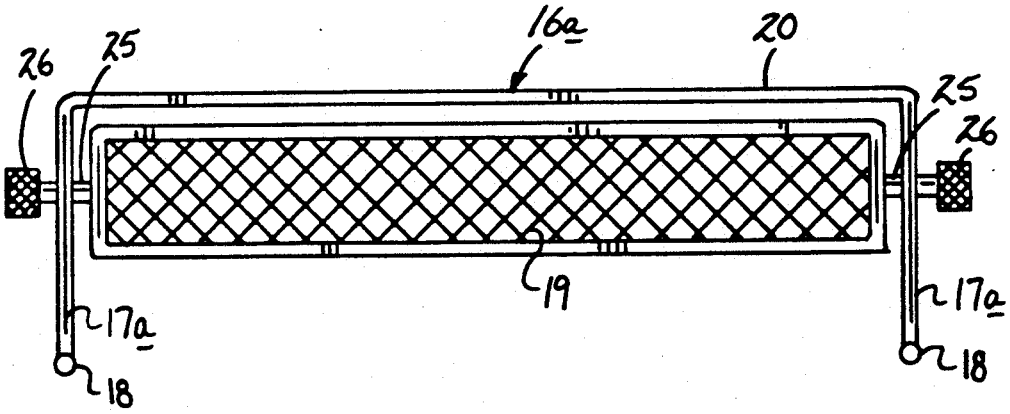

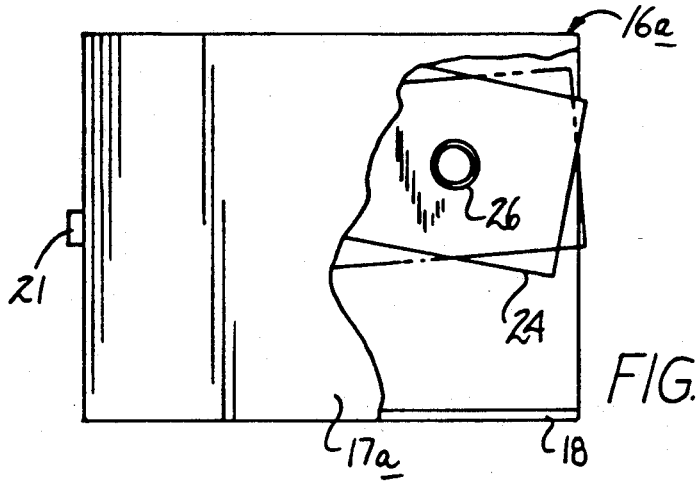
FIG. 7
FIG. 8
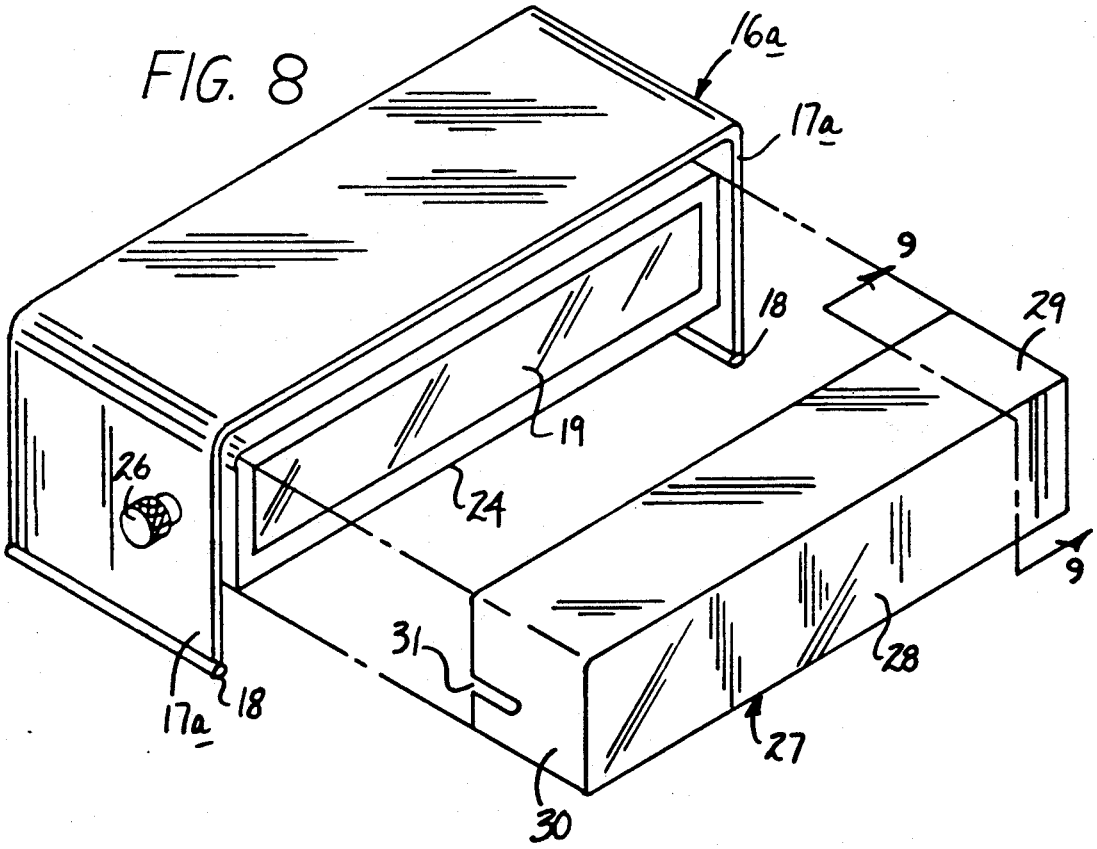
FIG. 9
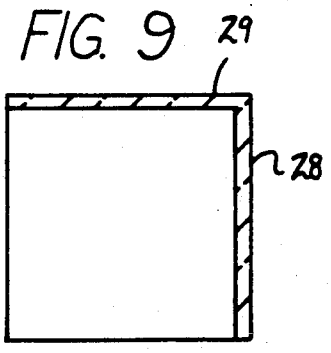

GAME LIGHT APPARATUS

BACKGROUND OF THE INVENTION

1. Field of the Invention

The field of invention relates to illumination organization, and more particularly pertains to a new and improved game light apparatus wherein the same is selectively and slidably mounted to overlie and associated electronic game member.

2. Description of the Prior Art

Illumination type organizations to direct an associated illumination to a companion structure is known in the prior art to provide such illumination as required. Such a prior art organization may be found in U.S. Pat. No. 4,905,127 to Kaminski wherein the illumination member includes elastomeric strap to secure the illumination member to an underlying electronic housing member.

U.S. Pat. No. 4,598,340 to Dwosh, et al. sets forth a light organization positionable to overlie a framework, wherein the framework is vertically oriented and the illumination is projected downwardly onto the framework.

U.S. Pat. No. 4,432,042 to Zeller sets forth a book light arranged for mounting to a book to permit selective reading of the book as desired.

U.S. Pat. No. 4,462,064 to Schweitzer sets forth a battery powered lamp member, wherein the lamp member is received within a sleeve and the sleeve is arranged for mounting upon a headband for use by an individual.

U.S. Pat. No. 4,831,500 to McNemar sets forth an illumination member that is arranged for strapping onto a housing to direct illumination onto a viewing screen of the housing.

As such, it may be appreciated that there continues to be a need for a new and improved game light apparatus as set forth by the instant invention which addresses both the problems of ease of use as well as effectiveness in construction and in this respect, the present invention substantially fulfills this need.

SUMMARY OF THE INVENTION

In view of the foregoing disadvantages inherent in the known types of illumination apparatus now present in the prior art, the present invention provides a game light apparatus wherein the same permits sliding mounting of a game light in relation with an electronic viewing screen mounted in a separate housing. As such, the general purpose of the present invention, which will be described subsequently in greater detail, is to provide a new and improved game light apparatus which has all the advantages of the prior art illumination apparatus and none of the disadvantages.

To attain this, the present invention provides an apparatus including a slide-on illumination housing of a generally "U" shaped configuration, including cylindrical guides receivable within elongate grooves that are provided within an associated electronic game member whose housing includes side walls containing the grooves, wherein the illumination member overlies a viewing screen of the game member. The illumination member includes an illumination screen, wherein the illumination screen may be pivotally mounted to the illumination housing and may further include a polarized filter to limit intensity of light directed onto the viewing screen.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved game light apparatus which has all the advantages of the prior art illumination apparatus and none of the disadvantages.

It is another object of the present invention to provide a new and improved game light apparatus which may be easily and efficiently manufactured and marketed.

It is a further object of the present invention to provide a new and improved game light apparatus which is of a durable and reliable construction.

An even further object of the present invention is to provide a new and improved game light apparatus which is susceptible of a low cost of manufacture with regard to both materials and labor, and which accordingly is then susceptible of low prices of sale to the consuming public, thereby making such game light apparatus economically available to the buying public.

Still yet another object of the present invention is to provide a new and improved game light apparatus which provides in the apparatuses and methods of the prior art some of the advantages thereof, while simultaneously overcoming some of the disadvantages normally associated therewith.

Still another object of the present invention is to provide a new and improved game light apparatus wherein the same permits sliding mounting of the game light apparatus onto an electronic housing member to direct illumination of the housing and its association viewing screen.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is an isometric illustration of a prior art illumination device in association with an electronic housing.

FIG. 2 is an isometric illustration of the illumination member of FIG. 1.

FIG. 5 is an isometric illustration of a modified illumination housing utilized by the instant invention.

FIG. 6 is an orthographic frontal view, taken in elevation, of the modified illumination member utilized by the instant invention.

FIG. 7 is an orthographic side view, partially in section, of the modified illumination member utilized by the instant invention.

FIG. 8 is an isometric illustration of the modified illumination member utilized by the instant invention in association with a polarizing lens.

FIG. 9 is an orthographic view, taken along the lines 9—9 of FIG. 8, in the direction indicated by the arrows.

DESCRIPTION OF THE PREFERRED EMBODIMENT

Figure 3:
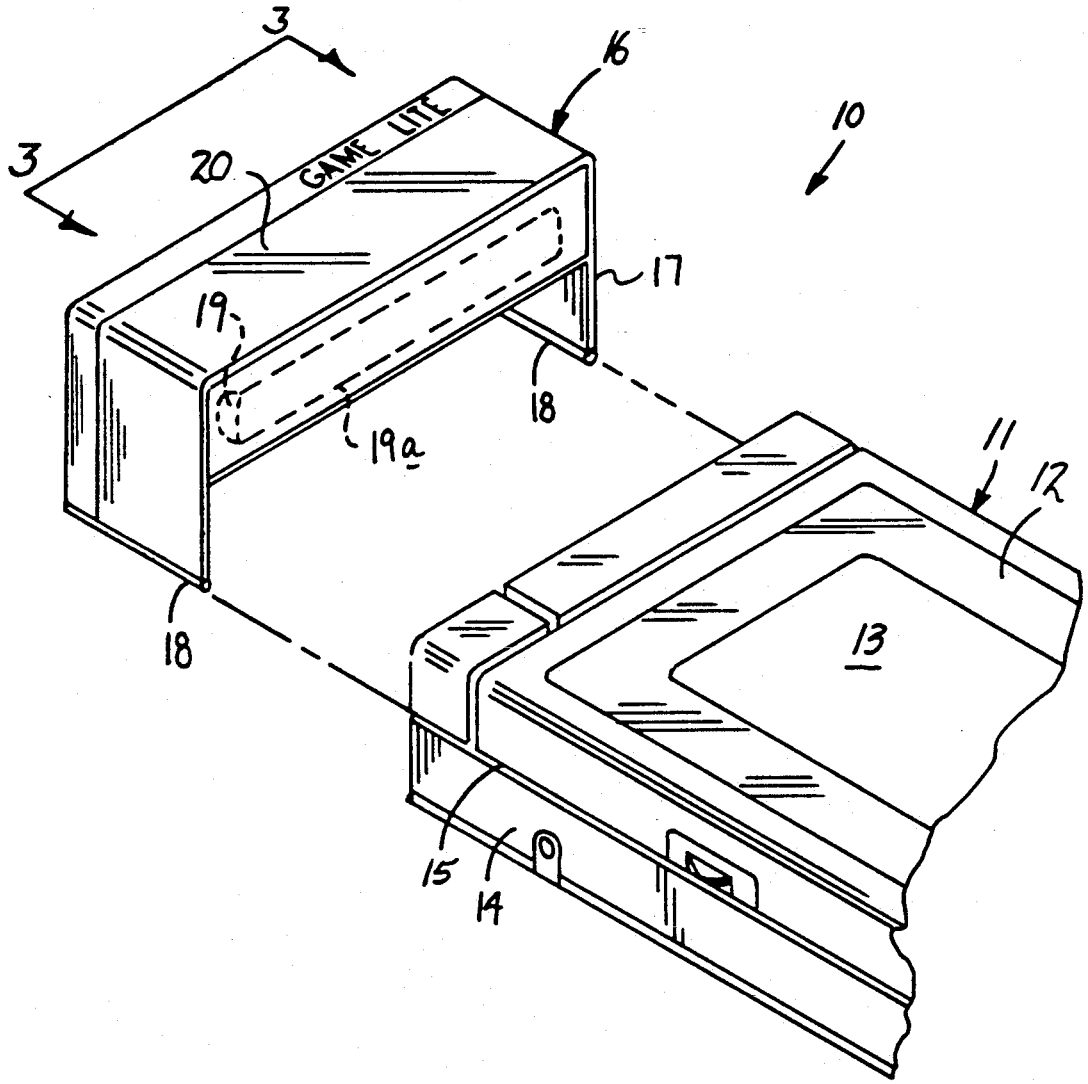
FIG. 3 is an isometric illustration, somewhat exploded, of the instant invention.

With reference now to the drawings, and in particular to FIGS. 1 to 9 thereof, a new and improved game light apparatus embodying the principles and concepts of the present invention and generally designated by the reference numeral 10 will be described.

FIG. 1 illustrates a prior art illumination housing 2, with a strap member 3 to secure the illumination organization relative to an electronic control housing. FIG. 2 illustrates the organization and the on/off switch mounted to a side wall thereof, in a manner as set forth in U.S. Pat. No. 4,905,127.

More specifically, the game light apparatus 10 of the instant invention essentially comprises an electronic game member 11 including a housing, with the housing defined by a top wall 12, spaced parallel side walls 14 orthogonally oriented relative to the top wall 12 and a viewing screen 13 positioned through the top wall 12. A groove member 15 is directed along each side wall 14 and arranged parallel to the top wall 12. An illumination member 16 is arranged for slidable securement onto the game member 11 and its associated housing by use of the grooves 15. The illumination member 16 includes a "U" shaped housing 17 defined by spaced parallel side legs and a top plate 20, wherein the top plate 20 is arranged orthogonally relative to the parallel side legs, with each lower terminal end of each parallel side leg defined by an equal predetermined length, and each lower terminal end including a cylindrical runner 18, with each cylindrical runner 18 slidably receivable within an associated or respective groove member 15. The side legs of the "U" shaped member are formed of a memory retentent material to normally bias the legs in the orientation as illustrated relative to the top plate 20. A translucent illumination plate 19 is formed through a forward end of the "U" shaped housing 17 containing an illumination bulb 19*a* therewithin operably associated through on/off switch 21 and a battery compartment 22 mounted through a rear wall 20*a* of a generally "U" shaped housing 17.

Figure 4:
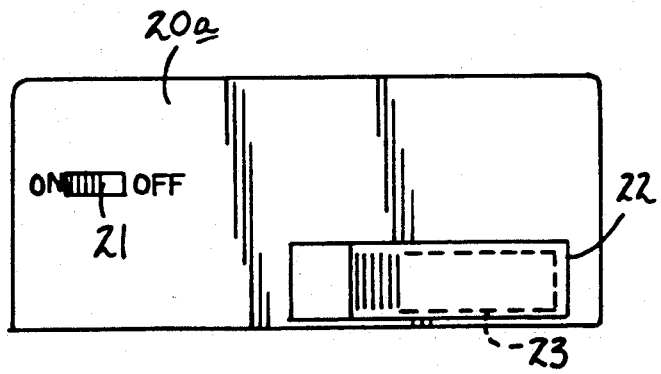
FIG. 4 is an orthographic rear view of the illumination member utilized by the instant invention.

FIG. 7 illustrates the use of a modified illumination member 16*a*, including an illumination bulb housing 24 pivotally mounted and contained between the spaced parallel side legs of the "U" shaped housing 17 underlying the top plate 20 in electrical communication with the on/off switch 21, in a manner as illustrated in FIG. 4. A pivot pin 25 is orthogonally directed through each side leg of the "U" shaped housing 17 and includes a manually graspable pivot pin handle 26, wherein each pivot pin 25 is frictionally retained within each side leg 17*a* of the housing 17. FIG. 7 illustrates the selective orientation of the translucent illumination plate 19 to permit selective positioning by an individual to minimize glare in use.

FIGS. 8 and 9 illustrate the use of a polarized filter 27 for securement to overlie a top wall of the illumination bulb housing 24 and the translucent illumination plate 19. The polarized filter 27 includes a frontal lens 28, a lens top ball 29, and lens side walls 30, with each side wall 30 including a slot 31 to receive each pivot pin 25 therewithin between each side wall of the illumination bulb housing 14 and an interior side wall of each "U" shaped housing side leg 17*a*. Use of the filter permits an individual to moderate intensity of light directed from the illumination bulb housing 24 through the illumination plate 19.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A game light apparatus comprising, in combination, an electronic game member including a housing, with the housing including a top wall orthogonally arranged relative to spaced parallel side walls, the top wall including a viewing screen directed therethrough, and each side wall includes a groove member arranged parallel to the top wall and spaced at a predetermined equal spacing from the top wall, and an illumination member, wherein the illumination member includes a "U" shaped housing, with the "U" shaped housing including spaced parallel side legs, each side leg of the side legs securable to a respective side wall of the game member; and wherein each side leg of the "U" shaped housing is formed of an equal predetermined length, and each lower terminal end of each side leg includes an elongate cylindrical runner, each cylindrical runner of each side leg complementarily receivable within a respective groove member of a side wall, and wherein the illumination member includes a translucent illumination plate arranged between the side legs and underlying a top plate of the "U" shaped housing and including an illumination bulb contained therewithin.

2. An apparatus as set forth in claim 1 wherein the translucent illumination plate is mounted to an illumination bulb housing, the illumination bulb housing is pivotally mounted underlying the top plate between the side legs, and a pivot pin is directed through each side leg orthogonally thereto and fixedly mounted to the illumination bulb housing, each pivot pin is coaxially aligned relative to one another and frictionally retained within a respective side leg.

3. An apparatus as set forth in claim 2 wherein the "U" shaped housing is formed of a memory retentent material to effect geometrical integrity to the "U" shaped housing when secured to the game member.

4. An apparatus as set forth in claim 3 including a polarized filter securable to the illumination bulb housing, the polarized filter including a frontal lens coextensive with and overlying the translucent illumination plate of the bulb housing, and the polarized filter including a lens top wall and lens side walls, each lens side wall including a lens side wall slot arranged orthogonally relative to the frontal lens, wherein each lens side wall slot frictionally receives a respective pivot pin between each side leg and each side wall of the illumination bulb housing.

* * * * *